US006582072B1

(12) United States Patent
Wotton et al.

(10) Patent No.: US 6,582,072 B1
(45) **Date of Patent: *Jun. 24, 2003**

(54) LINEFEED CONTROL IN BELT-TYPE PRINTERS

(75) Inventors: Geoff Wotton, Canyon Loop Battleground, WA (US); Steven B Elgee, Portland, OR (US); Jeffrey C. Madsen, Vancouver, WA (US)

(73) Assignee: Hewlett-Packard Development Co., L.P., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/542,504

(22) Filed: Apr. 3, 2000

(51) Int. Cl.[7] ..... B65H 29/32; B41J 2/01
(52) U.S. Cl. ..... 347/104; 271/197
(58) Field of Search ..... 347/104, 102; 400/635; 271/197, 276, 275; 355/73

(56) References Cited

U.S. PATENT DOCUMENTS

| | | | | | |
|---|---|---|---|---|---|
| 4,146,219 | A | * | 3/1979 | Phillips | 271/275 |
| 4,347,006 | A | | 8/1982 | Shakib | 400/187 |
| 4,676,683 | A | | 6/1987 | Uchikata | 400/656 |
| 4,952,950 | A | | 8/1990 | Bibl | 347/116 |
| 5,225,853 | A | * | 7/1993 | Kobayashi et al. | 347/33 |
| 5,287,123 | A | | 2/1994 | Medin | 347/17 |
| 5,296,873 | A | | 3/1994 | Russell | 346/25 |
| 5,371,531 | A | | 12/1994 | Rezanka | 347/43 |
| 5,406,321 | A | | 4/1995 | Schwiebert | 347/102 |
| 5,510,822 | A | | 4/1996 | Vincent | 347/102 |
| 5,668,584 | A | | 9/1997 | Broder | 347/102 |
| 5,674,345 | A | * | 10/1997 | Nash | 271/275 |
| 5,754,208 | A | | 5/1998 | Szlucha | 347/102 |
| 5,757,407 | A | * | 5/1998 | Rezanka | 347/104 |
| 5,896,154 | A | * | 4/1999 | Mitani et al. | 347/104 |
| 5,993,094 | A | * | 11/1999 | Lee | 347/104 |
| 6,092,891 | A | * | 7/2000 | Okubo et al. | 347/104 |
| 6,234,472 | B1 | * | 5/2001 | Juan | 347/104 |
| 6,315,404 | B1 | * | 11/2001 | Wotton et al. | 347/102 |

OTHER PUBLICATIONS

Hall et al.; Inkjet Printer Print Quality Enhancement Techniques, Feb. 1994 Hewlett Packard Journal, pp. 35–40.

* cited by examiner

*Primary Examiner*—Judy Nguyen
*Assistant Examiner*—Julian D. Huffman

(57) ABSTRACT

Described are techniques for preventing the forces attributable to shrinkage of print media from shifting print media on the media-carrying belt in the vicinity of the print zone. In one approach, a "hold zone" is identified immediately upstream of the print zone. In the hold zone, a mechanism is employed for securing the media to be immovable relative to the belt. The hold mechanism provides sufficient force to overcome tension transmitted to the dry portion of the media as the remaining portion shrinks. In one embodiment, the hold mechanism is a roller that pinches the media against the belt. In another embodiment, the amount of vacuum pressure applied to the belt is regulated so that the suction force applied to the media in the hold zone is greater than the suction force applied to the media in the portion upstream of the hold zone.

4 Claims, 1 Drawing Sheet

LINEFEED CONTROL IN BELT-TYPE PRINTERS

TECHNICAL FIELD

This invention relates to the control of linefeed distances in a heated, belt-type system for advancing print media through a printer.

BACKGROUND AND SUMMARY OF THE INVENTION

An ink-jet printer includes at least one print cartridge that contains ink within a reservoir. The reservoir is connected to a print head that is mounted to the body of the cartridge. The print head is controlled for ejecting minute droplets of ink from the print head to a sheet of print medium, such as paper, that is advanced through the printer.

Many ink-jet printers include a carriage for holding the print cartridge. The carriage is scanned across the width of the paper, and the ejection of the droplets onto the paper is controlled to form a swath of an image with each scan. Between carriage scans, the paper is advanced so that the next swath of the image may be printed. Sometimes, more than one swath is printed before the paper is advanced. In some printers, a stationary print head or array of print heads may be provided to extend across the entire width of the paper that moves through the printer.

The relative position of the print head(s) and paper must be precisely maintained to effect high-resolution, high-quality printing. This precision is especially important in the region known as the "print zone" of the printer, which is the space where the ink travels from the print head to the print media. Thus, in the course of advancing the print media between swaths, encoders and associated servo systems are employed for controlling the precise advance of the media. This incremental advance is commonly called "linefeed. " Thus, the control of the amount of the advance, the linefeed distance, is critical for high print quality.

One method of securing print media, such as a sheet of paper, for movement through a printer is to direct the paper against one side of a perforated belt. Vacuum pressure is applied to the other side of the belt and, thus, through the belt perforations to secure the paper to the belt. The belt, with secured paper, is moved relative to the print head and through the print zone where ink is printed on the paper.

The belt may be configured as an endless loop and secured between a pair of rollers that are mounted to the printer to drive the belt under tension. The upper surface of the belt transports the paper toward the print zone. The porous belt moves over a support surface that includes vacuum ports through which the vacuum pressure is applied to the belt and to the paper that is carried by the belt.

Any of a variety of encoder mechanisms can be employed for controlling linefeed distances. Typically, a rotary encoder is connected to the belt drive roller. The information provided by the encoder, in combination with information produced by a media edge sensor, is processed by the printer controller to control the linefeed distance between swaths. Such processing may account for runout errors or the like, but otherwise assumes that there is no movement of the media relative to the belt that carries it.

Another important factor affecting the print quality of ink-jet or other liquid-ink printers is drying time. The print media movement must be controlled to ensure that the liquid ink dries properly once printed. If, for example, sheets of printed media are allowed to contact one another before ink is adequately dried, smearing can occur as a result of that contact.

Heat may be applied to the print media in order to speed the drying time of the ink. An effective way to heat the print media is by conduction, in a manner that will not overheat the print head nor interfere with the trajectory of the droplets expelled from the print head. This can be accomplished by heating the underside of the belt by conduction, which heat is thus transferred to the media carried by the belt.

Normally, print media carries at least some moisture with it. For example, a sealed ream of standard office paper comprises about four and one-half percent moisture. High amounts of moisture in the media, such as paper, may be present in humid environments. Thus, the paper shrinks as the applied heat dries the paper.

The moisture in the paper may be substantially removed by the heated belt before the leading portion of the media passes into the print zone. Nonetheless, the shrinkage or contraction that occurs in the portion of the media that is outside of the print zone ("upstream" of the print zone) can tug on the dry portion of the media by an amount sufficient to cause the media to shift slightly in the region in or near the print zone. This shifting would occur, for example, where the overall vacuum force applied to the media upstream of the print zone (that is, where the media shrinks as it dries) is greater than the vacuum force applied to the remaining portion of the media. The term "upstream" means in the direction opposite to the direction of paper movement.

This shifting movement of the media in the vicinity of the print zone introduces errors in the calculation of the linefeed distances. The encoder, which follows belt or drive roller motion, does not track the movement of the shrinking paper relative to the belt. Such errors lead to degradation in print quality as a result of artifacts known as "banding."

The present invention is generally directed to techniques for preventing the forces attributable to shrinkage of print media from shifting the media relative to the belt in the vicinity of the print zone.

In one approach to the invention, a "hold zone" is identified immediately upstream of the print zone. In the hold zone a mechanism is employed for securing the media to be immovable relative to the belt. The hold mechanism provides sufficient force to overcome tension transmitted to the dry portion of the media as a result of the shrinkage in the remaining, upstream portion of the media.

In one embodiment, the hold mechanism is a roller that pinches the media against the belt.

In another embodiment, the amount of vacuum pressure applied to the belt is regulated so that the suction force applied to the media in the hold zone is greater than the suction force applied to the media in the portion upstream of the hold zone.

Apparatus and methods for carrying out the invention are described. Other advantages and features of the present invention will become clear upon review of the following portions of this specification and the drawings.

DETAILED DESCRIPTION OF PREFERRED EMBODIMENTS

Figure 1:
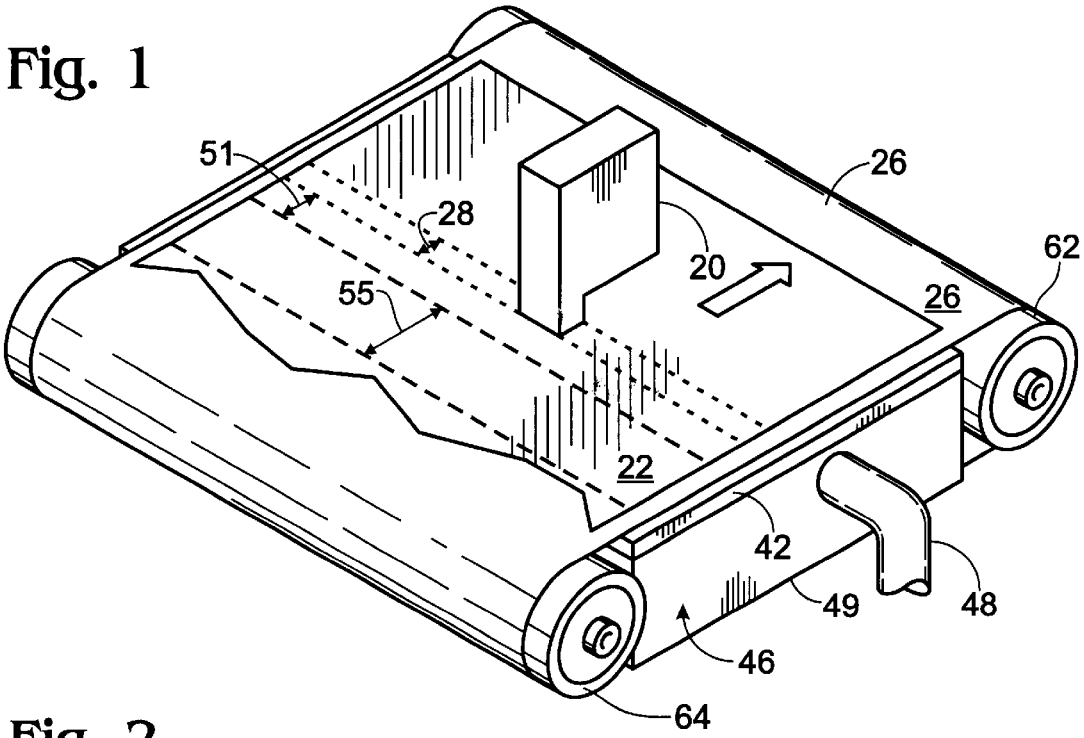
FIG. 1 is a diagram showing the primary components of one embodiment of an ink-jet printer that includes a heated, belt-type media advance system to which the present invention is adaptable.

The diagram of FIG. 1 shows an ink-jet print cartridge 20, which may be mounted to a printer by conventional means such as a movable carriage assembly (not shown). For illustrative purposes, only one cartridge is shown in the figures, although it is contemplated that more than one cartridge may be employed. For instance, some color printers use four cartridges at a time, each cartridge carrying a particular color of ink, such as black, cyan, yellow, and magenta. In the present description, the term "cartridge" is intended to mean any such device for storing liquid ink and for printing droplets of the ink to media. Preferred cartridges are available from Hewlett Packard Co. of Palo Alto, Calif., http://www.hp.com. The cartridges may be connected to remote sources of ink that supplement the ink supply that is stored in each cartridge.

The carriage assembly supports the cartridge 20 above print media, such as a sheet of paper 22. A print head 24 (see FIG. 2) is attached to the underside of the cartridge. The print head 24 is a planar member and has an array of nozzles through which the ink droplets are ejected. The cartridge 20 is supported so that the print head is precisely maintained at a desired spacing from the paper 22, such as, for example, between 0.5 mm to 1.5 mm from the paper. The paper 22 is advanced through the printer, and the cartridge print head 24 is controlled to expel ink droplets onto the paper.

Figure 2:
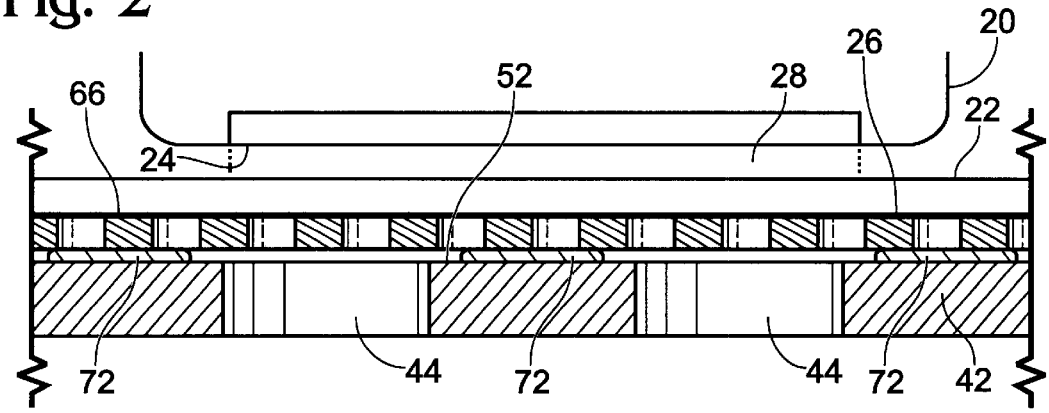
FIG. 2 is an enlarged detail view of a portion of the embodiment depicted in FIG. 1.

In the vicinity of the cartridge 20, the paper 22 is supported on a moving conveyor belt 26. The belt 26 moves the paper 22 through the printer's print zone 28 (FIG. 2). As noted above, the print zone 28 is the space in the printer where the ink is moved from the print head 24 to the paper 22. Two imaginary boundaries of the print zone 28 are shown in dashed lines in FIG. 2.

The paper 22 is heated as it is moved through the printer. Heat is applied to the paper in conjunction with mechanisms for applying vacuum pressure to the paper (or any other media) to support the paper on the belt as it moves through the printer.

Preferably, the heat is applied to the paper 22 while the paper is in the print zone 28. Also provided are mechanisms for heating the paper before and after it moves through the print zone.

Figure 3:
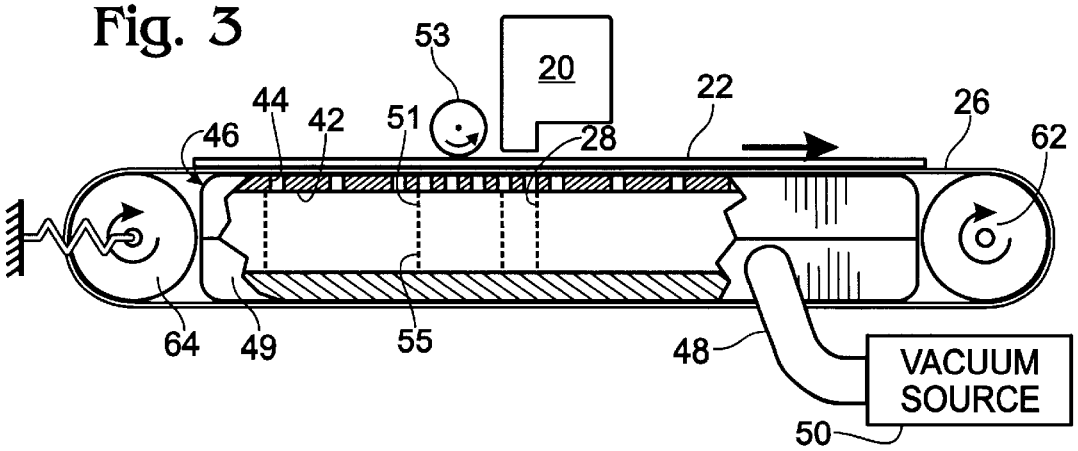
FIG. 3 is a cross section view of the embodiment of FIG. 1.

With reference to FIGS. 1–3, the particulars of the system for heating and transporting the media through the printer are now described. The system includes a platen 42 that generally provides support for the belt 26 that, in turn, carries media such as paper sheets 22 through the print zone of the printer.

The platen 42 is a rigid member, formed of material such as stainless steel. The platen may also be formed of copper or another metal having a copper-coated outer surface. Preferably, the surface of the platen over which the belt 26 moves has high thermal conductivity for reasons described more below.

It is also contemplated that the platen 42 may be formed of material having low thermal mass. This would enable a somewhat more responsive control of heat applied to the media directly from heaters that are mounted to the platen and described below.

The belt 26 is porous, and vacuum pressure is employed for drawing the paper 22 against the belt and platen to support the paper as it is advanced through the printer. Thus, the platen 42 has ports 44 formed through it (FIG. 2). The platen 42 also forms the top of a vacuum chamber or box 46 (FIG. 1) that is inside the printer.

The vacuum box 46 includes a body 49 to which the platen 42 is attached. The box 46 is thus enclosed except for the ports 44 in the platen 42 and a conduit 48 to a vacuum source 50. The vacuum source is controlled to reduce the pressure in the interior of the box 46 so that suction or vacuum pressure is generated at the ports 44.

The platen 42 has a planar support surface 52 (FIG. 2) that faces the print head 24. The ports 44 in the platen open to the support surface 52. The ports are formed in rows across the support surface. The ports 44 are sized and arranged to ensure that vacuum pressure is uniformly distributed over the platen surface 52.

As explained more fully below, in one embodiment the ports 44 are arranged to provide variations in the suction force applied to the media in different zones of the platen surface.

The belt 26 is configured as an endless loop between a fixed drive roller 62 and tension roller 64 (FIG. 1). In the figures, the belt 26 is shown rotating clockwise, with a transport portion 66 of the belt (FIG. 2) sliding over the support surface 52 of the platen 42. The return portion of the belt 26 underlies the vacuum box 46. Paper 22 is directed onto the transport portion by conventional pick and feed roller mechanisms (not shown).

The porous belt 26 permits communication of vacuum pressure to the underside of the paper 22. The belt 26 also conducts heat to the paper 22 (or other type of print media) that is carried on its transport portion 66. To this end, the belt preferably is made of heat conductive material.

In a preferred embodiment, the belt is formed of a stainless steel alloy, commonly known as Invar 36, having a thickness of about 0.125 mm. The belt 26 has a width that is sufficient to cover all but the margins of the platen 42 (FIG. 1). The belt 26 is heated by conduction. In a preferred embodiment, the conductive heating of the belt is accomplished by the use of heaters 72 that are attached to the support surface 52 of the platen 42 as best shown in FIG. 2.

The heaters 72 are comprised of an array of linear, resistive heating elements that extend between the rows of vacuum ports 44 that are defined on the support surface 52 of the platen.

Any of a number of techniques may be employed for heating the belt. One preferred way that incorporates the heaters 72 mentioned above is described in U.S. patent application Ser. No. 09/412,842, which is commonly owned by the assignee of the present application and hereby incorporated by reference.

As noted above, shrinkage or contraction that occurs in the portion of the media that is outside of the print zone ("upstream" of the print zone) can tug on the dry portion of the media by an amount sufficient to cause the media to shift slightly in the region in or near the print zone. With reference to FIG. 1, this upstream portion can be referred to as a support zone 55. In this zone 55, the moisture in the paper is removed by the underlying heaters, which removal results in the shrinkage discussed above.

In a preferred embodiment of the invention, the paper is securely held against the belt 26 in the region upstream and adjacent to the print zone 28. This region can be designated as the hold zone 51 (FIG. 3). Preferably, a pinch roller 53 is rotatably mounted to the printer and urged downwardly to pinch the paper 22 against the belt with an amount of force sufficient to resist movement of the paper 22 relative to the belt as might otherwise occur because of the tensile forces induced as a result of paper shrinkage in the support zone 55 (i.e., to the left of the hold zone in FIG. 3).

Put another way, the hold mechanism applied in the hold zone 51 secures the paper 22 so that any shrinkage movement of the paper 22 relative to the belt 26 is constrained to occur in the support zone 55, outside of the hold zone 51.

It is contemplated that other pinching devices may be employed in lieu of the roller 53 described above. For instance smooth, arcuate guide members may be urged against the paper and belt at the margins of the paper.

As another approach to securing the paper to the belt in the hold zone 51, the vacuum pressure applied to the paper 22 may be regulated in a manner such that the suction force applied in the hold zone 51 is greater than the suction force applied in the support zone 55. With this approach, the suction force in the support zone (and not the hold zone) will yield to the tensile forces in the paper attributable to shrinkage. To arrive at this, the ports 44 in the platen 42 are configured and arranged so that the greatest amount of the surface area on the underside of the paper 22 is exposed to vacuum pressure in the hold zone, so that the greatest amount of suction force is delivered there.

There are a variety of other ways to vary the vacuum pressure in a manner such that the greatest suction force is delivered in the hold zone. For example, the vacuum box 46 could be divided into discrete chambers or compartments corresponding to each of the print, hold, and support zones. Separate conduits from the vacuum source would be connected to each chamber. The vacuum pressure provided by the conduits could be regulated (as by flow restriction or valving) to apply the desired variations in vacuum pressure to the chambers. With this approach, the ports 44 in the platen 42 could be otherwise uniformly sized and distributed across all zones.

The technique of securing the paper 22 to be immovable relative to the belt in the hold zone via vacuum pressure may be undertaken alone or in combination with a pinch roller. In either event, it is contemplated that the holding force applied there may be of a magnitude sufficient for eliminating the need for vacuum pressure to be applied in the support zone 55.

As respects the surface area of the platen downstream of the print zone 28, vacuum pressure is applied to the belt (hence, to the paper) for the purpose of ensuring that the paper continues to engage the heat-conducting belt to facilitate drying of the ink that is applied to the paper by the cartridge 20. Inasmuch as some additional shrinking will occur as the ink-wetted media dries, it is preferred that the vacuum pressure applied downstream of the print zone is at a sufficiently low level to ensure that the associated suction force is not greater than that applied in the hold zone. This relatively lower force will ensure that any shifting of the shrinking paper in this drying region will not be transmitted to the upstream print zone or hold zone.

In view of the foregoing it will be appreciated that the portion of the print media in the hold zone 51, which is upstream of the print zone 28, will not move relative to the belt 26 and, as such, the printer controller can precisely predict the linefeed distances. In this regard, an encoder connected to the belt 26, the pinch roller 53, or drive roller 62 will provide position information that reliably indicates the paper position for accurate linefeed control.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. A method of securing a sheet of print media that is advanced through a printer that has a print zone in which ink is applied to the media, the method comprising:

supporting the media on a belt that moves the media toward and through the print zone;

applying suction through the belt and against the media in a hold zone that is adjacent to the print zone, the advanced media reaching the hold zone before reaching the print zone;

applying heat to the belt in a support zone that the advancing media reaches before reaching the hold zone;

applying suction through the belt and against the media in the support zone;

regulating the suction applied in the hold zone and support zone so that the amount of force applied to the media by the suction in the hold zone is greater than the amount of force applied to the media by the suction in the support zone; and providing for limited movement of the media relative to the belt in the support zone.

2. The method of claim 1 including the step of pinching the media against the belt in the hold zone in addition to applying suction through the belt and against the media in the hold zone.

3. An apparatus for supporting print media within a printer that has a print zone where ink is applied to print media, comprising:

a belt that is operable for moving media from a support zone, through a hold zone, and then into the print zone;

a heater underlying the belt in the support zone and in the hold zone for heating the belt in the support zone and the hold zone;

a source of suction for securing the media to the belt in the print zone;

a hold chamber connected to the source of suction and configured for directing suction through the belt and against the media in the hold zone thereby to hold the media immovable relative to the belt in the hold zone adjacent to the print zone;

a support chamber connected to the source of suction for directing suction through the belt and against the media in the support zone; and regulator means for regulating the source so that the suction forces applied against the media in the hold zone are greater than the suction forces applied against the media in the support zone.

4. An apparatus for of securing a sheet of print media that is advanced through a printer that has a print zone in which ink is applied to the media, the apparatus comprising:

a belt that supports the media and moves the media toward and through the print zone;

a source for applying suction through the belt and against the media in a hold zone that is adjacent to the print zone the media reaching the hold zone before the print zone;

a heater underlying the belt in a support zone that the advancing media reaches before the advancing media reaches the hold zone;

a platen connected to the source and configured for directing suction through the belt and against the media in the support zone; and a regulator for regulating the suction so that the amount of suction force applied to the media in the hold zone is greater than the amount of suction force applied to the media in the support zone.

* * * * *